US005592799A

United States Patent [19]

Reinke

[11] Patent Number: 5,592,799

[45] Date of Patent: Jan. 14, 1997

[54] ROOF SHINGLE TAB COVER SYSTEM

[76] Inventor: Richard F. Reinke, 4th & Bryson, Deshler, Nebr. 68340

[21] Appl. No.: 385,438

[22] Filed: Feb. 8, 1995

[51] Int. Cl.[6] ..... E04D 1/06

[52] U.S. Cl. ..... 52/529; 52/518; 52/527; 52/558

[58] Field of Search ..... 52/90.2, 518, 527, 52/529, 556, 558, DIG. 16, 746.11, 748.1

[56] References Cited

U.S. PATENT DOCUMENTS

| | | | |
|---|---|---|---|
| 632,691 | 9/1899 | Bates . | |
| 1,039,065 | 9/1912 | Maertens . | |
| 1,090,531 | 3/1914 | Hall . | |
| 1,318,125 | 10/1919 | Zimbelmann . | |
| 2,038,192 | 4/1936 | Overbury | 108/9 |
| 2,231,008 | 2/1941 | Ochs | 20/5 |
| 2,450,562 | 10/1948 | Robinson et al. | 108/13 |
| 3,412,517 | 11/1968 | Ellis et al. | 52/529 |
| 3,508,368 | 4/1970 | Tischuk et al. | 52/529 |

*Primary Examiner*—Wynn E. Wood

*Assistant Examiner*—Yvonne Horton-Richardson

*Attorney, Agent, or Firm*—Jacobson, Price, Holman & Stern, PLLC

[57] ABSTRACT

A generally rectangular shingle tab cover panel is provided for securement over each shingle tab to be covered and each cover panel includes a lower edge, an upper edge and side margins extending between the upper and lower edges. One of the side margins includes a downturned flange and the other side margin includes a downwardly depressed channel spaced slightly inward from the free marginal edge thereof. Each cover panel is applied over a corresponding shingle tab with the depending side marginal flange closely outward of the corresponding side edge of the associated shingle tab and the downwardly depressed channel received in the spacing between the other side edge of the corresponding shingle tab and the opposing side edge of the next adjacent shingle tab. The upper edge of the cover panel is inserted beneath the lower edges of the adjacent shingle tabs in the next upper course of shingle tabs and roofing nails are driven downward through the adjacent lower corner portions of the aforementioned adjacent next upper shingle tabs and also downwardly through longitudinally spaced central upper marginal portions of the cover panel.

13 Claims, 3 Drawing Sheets

ROOF SHINGLE TAB COVER SYSTEM

BACKGROUND OF THE INVENTION

1. Field of the Invention

This invention relates to a roofing cover system wherein the exposed tab portions of old asphalt shingles and the like are covered by metal cover panels in a manner interlocking the cover panels to the roofing tabs and securing, with shank type fasteners, the cover panels and free lower corner portions of the old roofing tabs to the underlying roof structure.

2. Description of Related Art

Various different forms of roofing cladding systems heretofore have been provided such as those disclosed in U.S. Pat. Nos. 632,691, 1,039,065, 1,090,531, 1,318,125, 2,038,192, 2,231,008 and 2,450,562. However, these previously known roofing covering systems do not include shingle tab covering panels which interlocking engage with each other as well as the underlying roofing tabs and which may be secured in operative position through the utilization of a pair of shank type fasteners secured downwardly through not the covering panels and the shingles of the tabs being covered but also the free lower corner portions of shingle tabs in the next above course of shingles.

SUMMARY OF THE INVENTION

The roof shingle tab cover system of the instant invention incorporates a shingle tab cover panel to be applied over each shingle tab of a shingled roof and the tab cover panels are substantially the same shape as the shingle tabs to be covered, but slightly larger in plan area.

The tab cover panels include down and back turned lower marginal edge flange means and one of the side margins of each cover panel includes downturned side flange means while the other side margin of each cover panels forms a downwardly depressed channel spaced inward of the free marginal edge thereof. The channel and the opposite side depending flange means terminate upwardly a spaced distance below the upper margin of the cover panel and the cover panel upper margin is adapted to be inserted beneath the free lower marginal edges of the shingles tabs of the adjacent next above course of shingles. The side flange means of each cover panel is adapted to be lapped over the second channel equipped side edge of the adjacent cover panel with the side downturned flange means received in the adjacent side of the channel in the adjacent cover panel.

After each course of cover panels has been applied to the corresponding shingle tabs and the upper marginal edges of the cover panels have been inserted beneath the lower marginal edges of the next upper course of shingle tabs, the free lower corner portions of the tabs of the next upper course of shingle tabs have shank type fasteners (such as roofing nails) driven downwardly therethrough with each pair of nails secured downwardly through adjacent tab corner portions also penetrating longitudinally spaced central portions of the upper margin of the underlying panel cover as well as the underlying shingle portions. In this manner the cover panels may be securely fastened in position in a manner with all attaching fasteners (roofing nails) being covered, each pair of roofing nails secured downwardly through longitudinally spaced central portions of the upper margin of each cover panel being covered by the lower marginal edges of the next upper course of installed cover panels.

The main object of this invention is to provide a longer lasting system for re-roofing existing shingled roofs.

Another object of this invention is to provide a roofing cover system for shingled roofs which does not require expensive removal of old shingles and disposal thereof.

Still another important object of this invention is to provide a roofing cover system for shingled roofs which does not require transport of heavy shingles to and from a job site.

A further object of this invention is to provide a roofing renewal system for shingled roofs which does not require protection for adjacent shrubbery during removal of old shingles.

Still another object of this invention is to provide a roofing renewal system for shingled roofs which does not require the lifting of heavy shingle bundles from ground level to roof level.

Another very important object of this invention is to provide a roofing cover system for shingled roofs which is easier to install and results in positive securement of the free corners of the old roofing shingle tabs to the roof structure.

Another very important object of this invention is to provide a roofing cover system including individual cover panels for each exposed shingle tab of the roofing being covered and wherein each cover panel is secured to the roofing through the use of two shank-type fasteners also secured downwardly through the lower corner portions of the underlying adjacent shingle tabs in the next higher course of shingle tabs to be covered.

A final object of this invention to be specifically enumerated herein is to provide a roofing cover system in accordance with the preceding objects and which will conform to conventional form of manufacture, be of simple construction and easy to install so as to provide a device that will be economically feasible, long lasting and relatively trouble free in operation.

These together with other objects and advantages which become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 3:
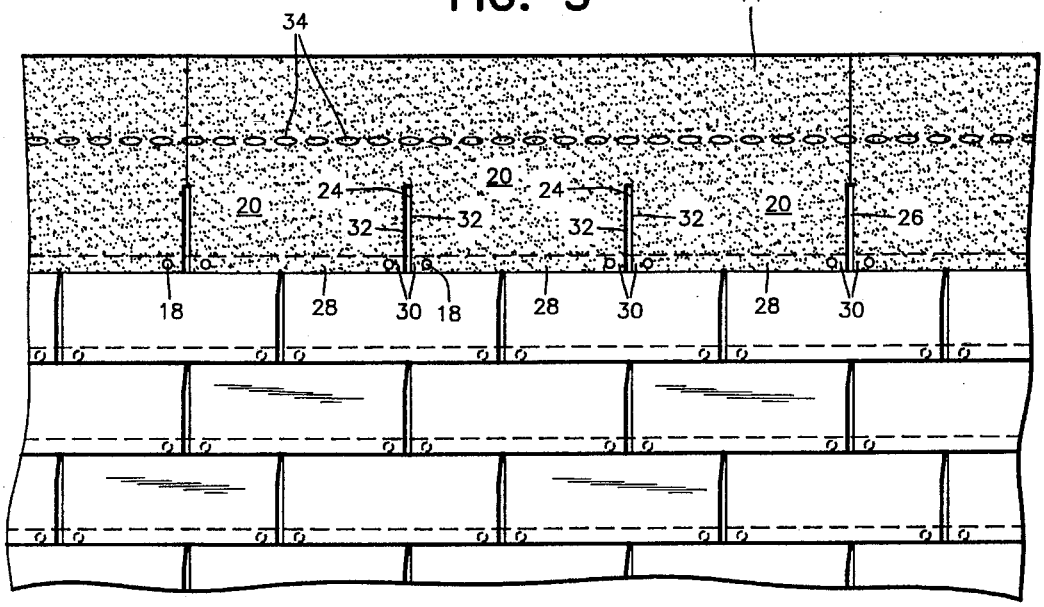
FIG. 3 is a fragmentary plan view of a shingled roof having four courses of shingle tabs covered through the utilization of the preferred shingle tab cover panels of the instant invention and with the second course of roofing shingles above the uppermost course of cover panels removed.
Figure 4:
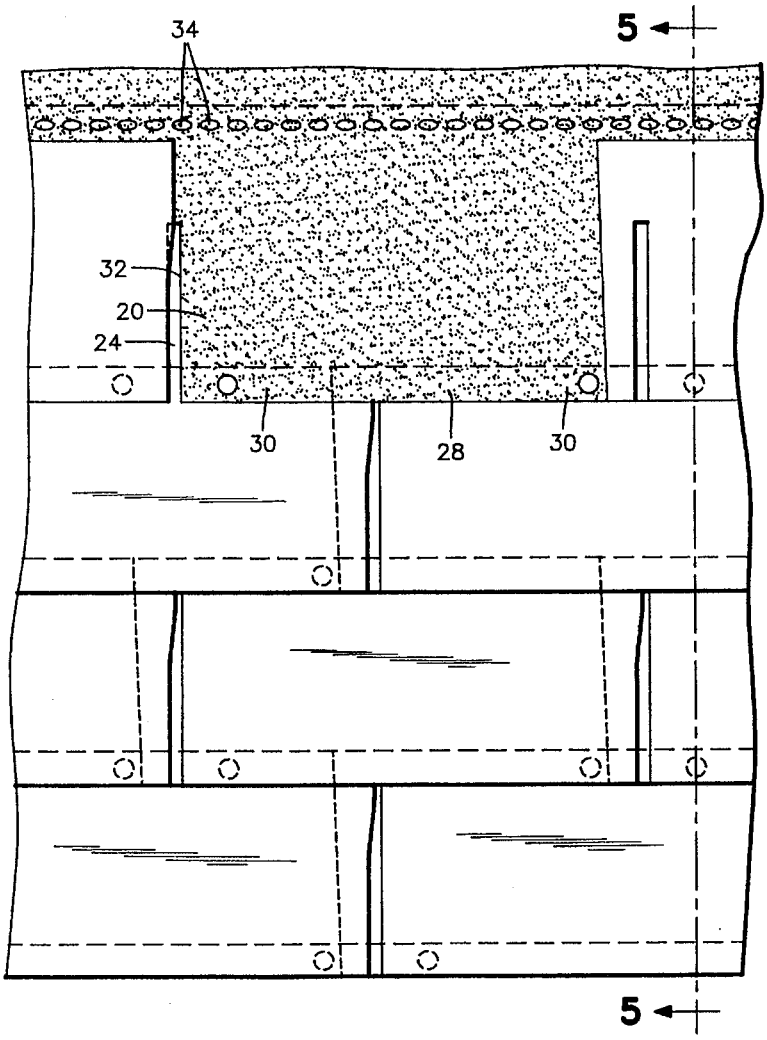
FIG. 4 is an enlarged fragmentary plan view of the central portion of the structure illustrated in FIG. 3, but with the center shingle tab cover in the upper reach of covers removed.
Figure 5:
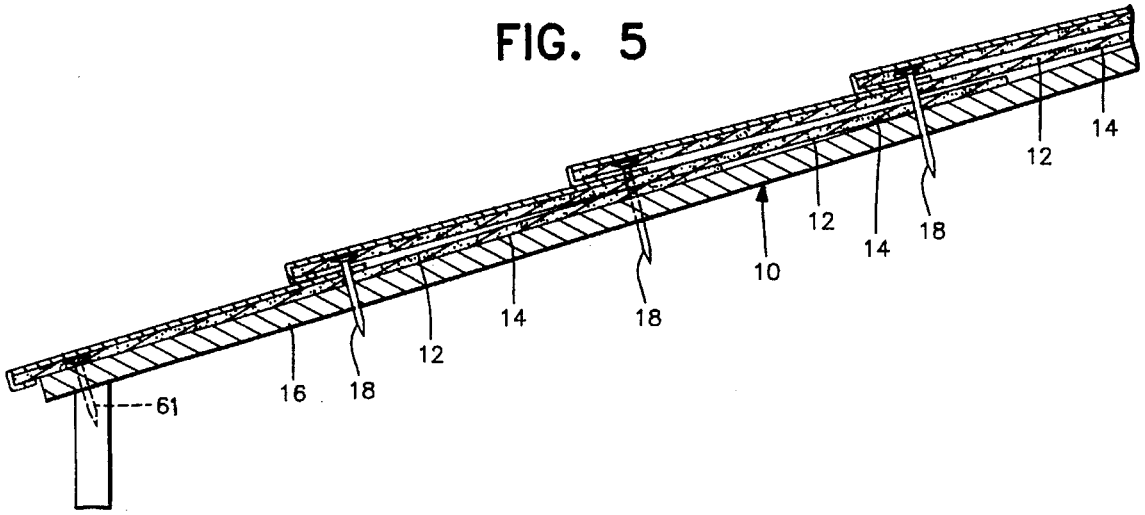
FIG. 5 is an enlarged fragmentary vertical sectional view take substantially upon the plane indicated by the section line 5—5 of FIG. 4.

Referring now more specifically to the drawings the numeral 10 in FIG. 5 generally designates a roof construction including a plurality of horizontal courses 12 of shingle panels 14 secured over underlying roofing sheets 16 through the utilization of roofing nails 18. Conventionally, a single shingle panel 14, see FIG. 3, includes three lower tabs 20 horizontally spaced apart longitudinally of the shingle panel to define slots 24 therebetween as well as additional slots 26 between the tabs 20 of horizontally adjacent shingle panels 14. Each tab 20 defines a lower edge 28 extending between opposite side free lower corner portions 30 and each tab 20 additionally includes a pair of opposite side edges 32 extending upwardly from the corner portions 30 to the upper ends of the slots 24. Also, each shingle panel 14 includes a row of longitudinally spaced dabs 34 of adhesive spaced longitudinally therealong. The adhesive dabs 34 are provided to adhere the free lower edges 28 of the next higher course of shingle panels thereto.

The foregoing may be considered as conventional roofing construction.

The preferred form of roofing cover of the instant invention is designed to cover the tabs 20 when the latter become worn and subject to leaking, the lower edges 28 of each course of tabs 20 extending downwardly over the next lower course of shingle panels 14 to substantially the upper ends of the slots 14 thereof. The roofing cover embodies a plurality of thin cover panels 36 which may be constructed of various durable materials such as sheet aluminum. The cover panels 36 include lower edges 38 extending between lower corners 42, opposite side margins 40 and 44 and upper edges 46.

Figure 1:
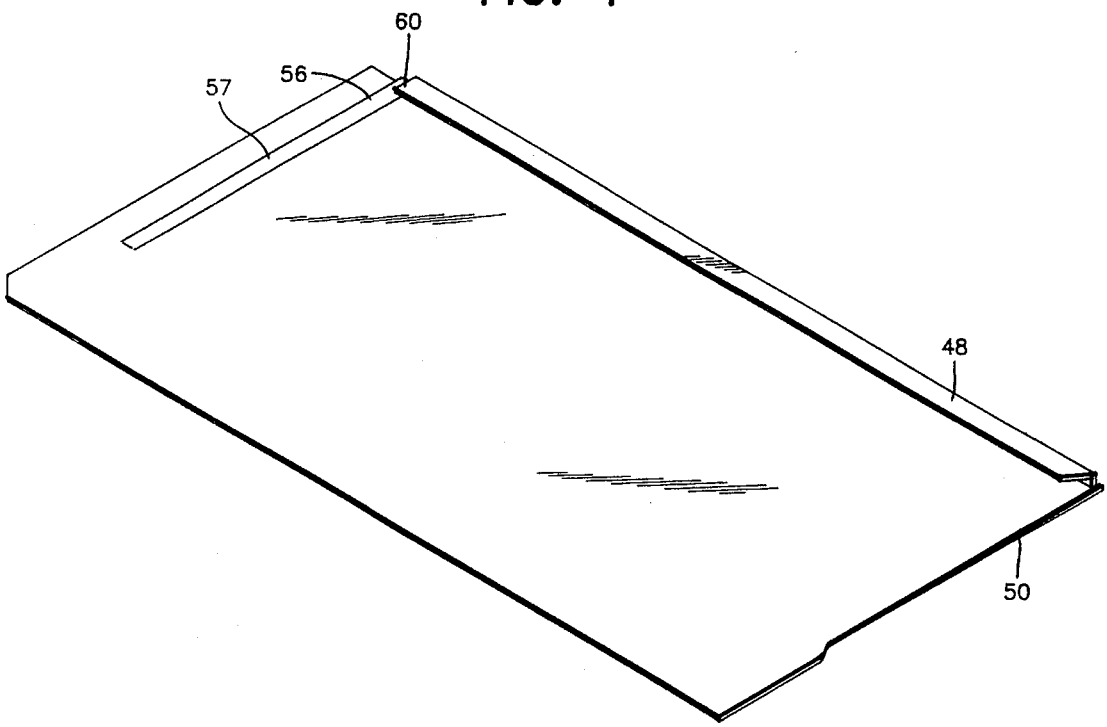
FIG. 1 is an underside perspective view of a preferred form of roofing shingle cover constructed in accordance with the present invention.
Figure 1A:
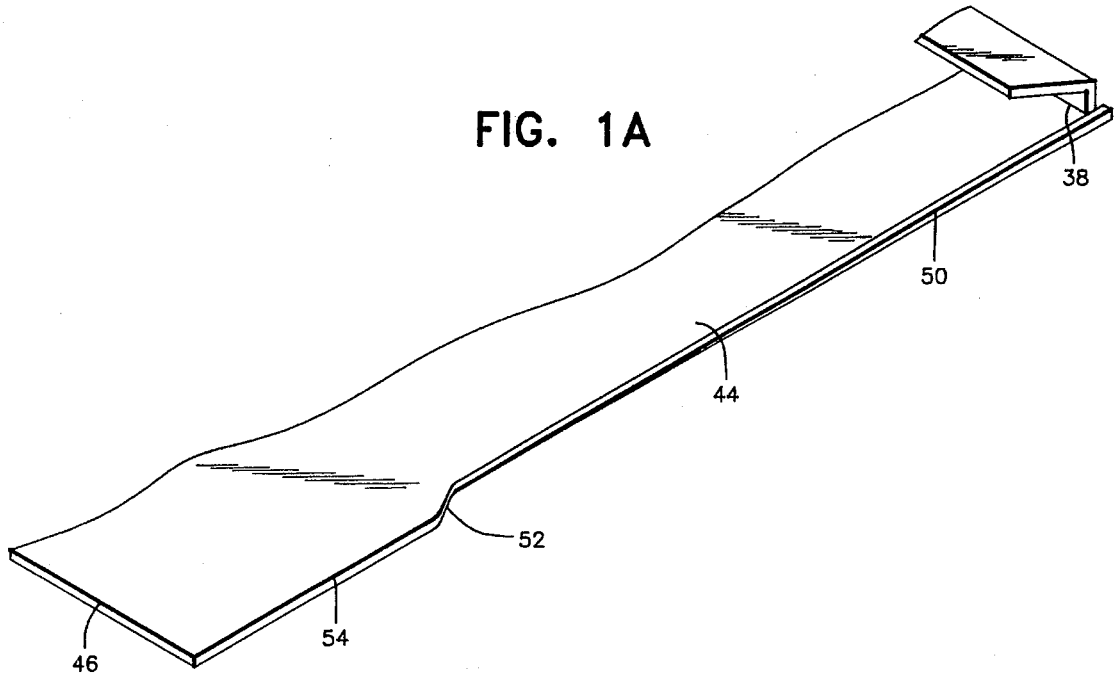
FIG. 1A is an enlarged fragmentary underside perspective view of the lower end portion of the preferred roofing shingle tab cover illustrated in FIG. 1.
Figure 2:
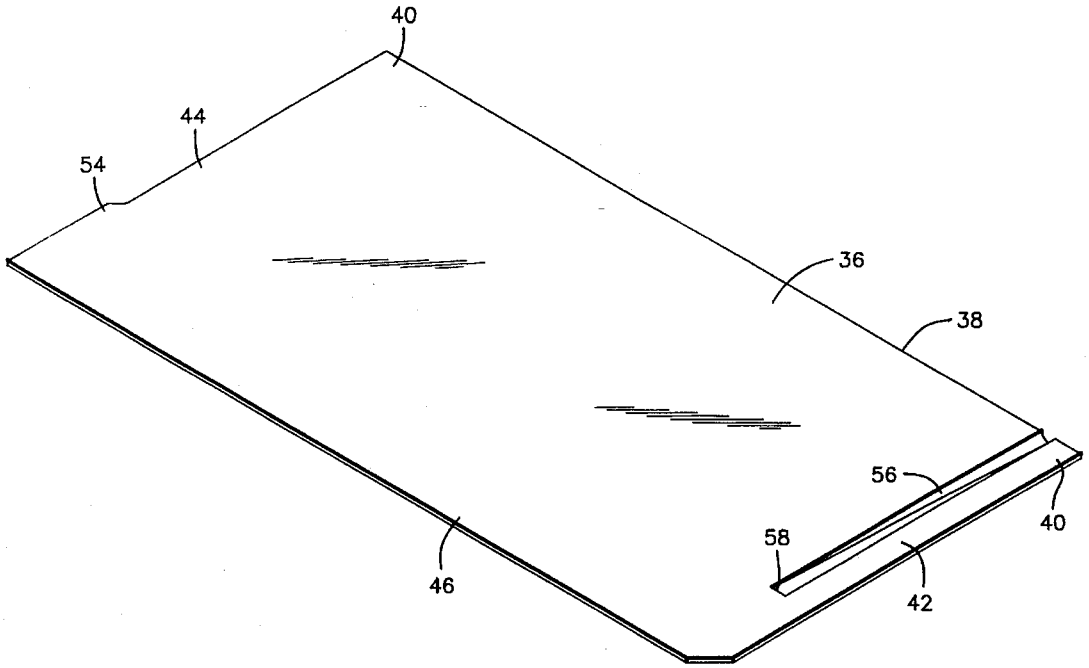
FIG. 2 is a top perspective view of the preferred form of shingle tab cover as seen from the upper margin thereof.

The panels 36 are randomly embossed (not shown) and include down and back turned flange means 48 comprising anchor structure extending along the lower edges 38 thereof. In addition, each side margin 44 includes downturned flange means 50 which tapers in height from the lower edge 38 toward the upper edge 46 and flares laterally outwardly as at 52 in order to form a lateral tab 54 immediately adjacent the upper edge 46. Each side margin 42, on the other hand, includes a downwardly depressed channel 56 which tapers in depth from the lower edge 38 toward the upper edge 46 and which terminates upwardly a spaced distance from the upper edge 46, the upper terminus 58 of the channel 56 being generally horizontally registered with the upper terminus 52 of the downturned flange means 50. Further, the down and back turned flange means 48 extends from the side margin 44 toward the side margin 42, but terminates as at 60, see FIG. 1, closely adjacent the channel 56. It is pointed out that the depth of the channel 56 is considerably greater than the thickness of the panel 36, and, therefore, that the underside of the channel 56 defines a downwardly projecting ridge 57.

In order to prepare the original roofing construction for covering, roofing nails 61 are initially driven downwardly through the lower corner portions of the tabs 20 in the lowest horizontal course of tabs. Then, a cover panel 36 is placed over each roofing tab 20 of the lowest course of tabs with the down and back turned flange of each cover panel 36 engaged under, and thus anchored beneath, the lower edge 28 of the corresponding tab 20. Further, the downturned flange means 50 of each cover panel 36 closely engages the corresponding edge 32 of the associated tab 20 and the channel 56 of each cover panel 36 is positioned in registry with the slot 24 on the other side of the corresponding tab 20 such that the rib 57 indexes in the corresponding slot 24, the side margin 42 of the cover panel 36 extending over the adjacent edge of the adjacent tab 20. However, as the cover panels 36 are applied over the corresponding tabs 20, the upper edges 46 of the cover panels 36 are inserted beneath the corner portions 30 of the horizontally offset tabs 20 of the next higher course of tabs. Also, each downturned flange is received in the channel 56 of the adjacent cover panel 36.

After each cover panel 36 is properly positioned, roofing nails 18 are driven downwardly through the exposed lower corner portions 30 of the adjacent tabs 20 of the next upper course of tabs 20 and also downwardly through longitudinally spaced central portions of the upper edge 46 of the installed cover panel 36, which nails 18 are covered, and thus hidden, by the cover panels 36 subsequently applied over the next upper course of tabs 20.

The cover panels 36 are constructed of sheet metal and are closely backed from beneath by the tabs 20 over which they are applied. Thus, the cover panels 36 are well cushioned against denting by hail. Further, the cover panels 36, by being cushioned from beneath by the tabs 20 over which they are applied, do not transmit the noise of rain or hail falling thereon into the interior of the structure over which the roof construction is applied. Still further, if the cover panels 36 are constructed of aluminum, summer sun radiation absorbed thereby is quickly dispersed into the ambient atmosphere before being transmitted to the underlying tabs 20. Thus, structures provided with the cover assembly of the instant invention do not experience as high under roof temperatures during the summer time as conventional shingled roof structures. Still further, heat loss through the roof construction 10 during sunny cold and windy winter days is reduced.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed is as follows:

1. In combination, a roofing cover assembly including vertically overlapped horizontal courses of slightly horizontally spaced apart roofing tabs of a predetermined plan shape and size each including free lower corner portions spaced along a corresponding course and interconnected by a lower edge and opposite side edges extending upwardly from said corner portions and wherein the tabs of each course of tabs are horizontally offset, in the direction in which the course extends, relative to an adjacent course of tabs, a cover system for said cover assembly including a plurality of thin cover panels each of generally said predetermined plan shape and slightly larger in size than said tabs, said cover panels each including lower corners interconnected by a lower edge, side margins extending upwardly from said lower corners and upper edges extending between upper portions of said side margins, one of said side margins including a down turned flange extending therealong, the other side margin including a downwardly offset trough extending therealong spaced at least slightly inwardly of an outer edge of said other side margin, said cover panels each overlying a corresponding tab with said downturned flange thereof disposed immediately outward of the corresponding tab edge and said trough thereof disposed immediately outwardly of the other side edge of said corresponding tab, said upper edge of each cover panel being inserted beneath the lower edges of the adjacent tabs of the next upper course of tabs, said troughs depending beneath said cover panels and being received in spaces between horizontally adjacent tabs and terminating upwardly below said upper edges, said downturned flange being downwardly received in said troughs, said lower corner portions having roofing fasteners secured downward therethrough and also downwardly through longitudinally spaced portions of the central area of the upper edges of the underlying cover panels and anchor structure anchoring said lower edge of each cover panel to the lower edge of the corresponding roofing tab.

2. The combination of claim 1 wherein said cover panels are constructed of sheet metal.

3. The combination of claim 2 wherein said panels are randomly embossed.

4.The combination of claim 1 wherein said anchor structure includes a down and back turned flange along at least a portion of said lower edges of said cover panels hooked beneath the lower edges of the corresponding tabs.

5. The combination of claim 4 wherein said lower edge down and back turned flange extends at least substantially fully between said one side margin and said trough of the corresponding cover panel.

6. The combination of claim 1 wherein said side margin down turned flange terminates upwardly along said one side margin of said cover panels below said upper edge thereof in laterally outwardly flared tabs.

7. A thin cover panel for use in covering the tabs of roofing shingles, said cover panel being generally rectangular in plan shape and including a lower edge, an upper edge and opposite side margins extending between and interconnecting said upper edge and lower edge, said lower edge including a down and back turned flange for embracingly engaging the lower edge portion of a roofing shingle tab over which said panel is disposed, one of said side margins including a downturned flange for disposition immediately outwardly of a corresponding edge of said tab, said downturned flange, adjacent said upper edge, flaring outwardly into a lateral tab substantially coextensive with said one side margin, the other of said side margins including a downwardly depressed trough for downward reception in spacing between slightly horizontally spaced apart underlying shingle tabs and for downwardly receiving therein said downturned flange of a horizontally adjacent cover panel, said trough terminating upwardly adjacent said upper edge and decreasing in depth.

8. The cover panel of claim 7 wherein said trough, adjacent said upper margin, decreases in depth to at least substantially zero depth.

9. The cover panel of claim 7 wherein said panel is constructed of aluminum.

10. The cover panel of claim 9 wherein said panel is randomly embossed.

11. The method of covering worn, exposed tabs of a shingled roof wherein the roof has horizontal courses of shingles secured thereover defining vertically lapped horizontal courses of slightly horizontally spaced apart shingle tabs approximately one half width horizontally offset relative to the tabs of adjacent courses of tabs and with each tab including a free lower edge extending between free lower corner portions, said method including:

1) Providing a plurality of thin cover panels of generally the same shape but slightly larger in plan area than said tabs and with each cover panel including a lower edge equipped with a down and back turned flange, 2) Securing the free lower corners of the tabs of the lowest course of tabs to the underlying, 3) Applying one of said cover panels over each of the tabs of the lowest course of tabs with each cover panel having its down and back turned flange engaged beneath the corresponding tab lower edge and with each cover panel upper edge inserted beneath a free lower corner portions of the adjacent tabs of the next upper course of tabs, 4) Securing said lower corner portions of said adjacent tabs as well as underlying longitudinally spaced central areas of the underlying cover panel upper edges to an underlying roofing structure, and 5) Repeating steps 3) and 4) for each successive upper course of tabs.

12. The method of claim 11 wherein step (2) includes driving roofing nails downwardly through said free lower corners of the tabs of the lowest course of tabs to mechanically secure the last mentioned lower corners to the underlying roofing structure.

13. The method of claim 11 wherein step (4) includes downwardly driving a roofing nail through said corner portions of said adjacent tabs as well as underlying longitudinally spaced central areas of the underlying cover panel upper edges and into the underlying roofing structure.

* * * * *